US011680767B2

(12) United States Patent
Barnett

(10) Patent No.: US 11,680,767 B2
(45) Date of Patent: Jun. 20, 2023

(54) MULTI-STROKE LEVER ACTION CROSSBOW

(71) Applicant: Barnett Outdoors, LLC, Tarpon Springs, FL (US)

(72) Inventor: David A. Barnett, Tampa, FL (US)

(73) Assignee: Barnett Outdoors, LLC, Tarpon Springs, FL (US)

( * ) Notice: Subject to any disclaimer, the term of this patent is extended or adjusted under 35 U.S.C. 154(b) by 0 days.

(21) Appl. No.: 17/738,811

(22) Filed: May 6, 2022

(65) Prior Publication Data

US 2022/0357124 A1 Nov. 10, 2022

Related U.S. Application Data

(60) Provisional application No. 63/185,700, filed on May 7, 2021.

(51) Int. Cl.
*F41B 5/12* (2006.01)

(52) U.S. Cl.
CPC ..... *F41B 5/12* (2013.01)

(58) Field of Classification Search
CPC ..... F41B 5/12
See application file for complete search history.

(56) References Cited

U.S. PATENT DOCUMENTS 3,043,287 A 10/1962 Nelson
3,670,711 A * 6/1972 Firestone ..... F41B 5/12 124/35.1
4,258,689 A 3/1981 Barnett
4,719,897 A 1/1988 Gaudreau
4,942,861 A * 7/1990 Bozek ..... F41B 5/12 124/35.1
5,215,069 A * 6/1993 Liu ..... F41B 5/12 124/40
9,528,792 B1 * 12/2016 Chang ..... F41B 5/1469
9,568,269 B1 2/2017 Chang
9,644,919 B1 * 5/2017 Liu ..... F41B 5/1403
9,746,278 B1 8/2017 Chang
(Continued)

OTHER PUBLICATIONS

Co-Pending U.S. Appl. No. 17/827,370, filed May 27, 2022, titled "Trigger Traverse Crossbow.".

(Continued)

*Primary Examiner* — John A Ricci
(74) *Attorney, Agent, or Firm* — Jones Walker LLP

(57) ABSTRACT

A multi-stroke lever action crossbow has two sets of cocking hooks. The first cocking hooks are disposed on cocking links slidingly coupled to a crossbow body. The second cocking hooks are retractable. The second cocking hooks are disposed on a cocking arm, which is pivotally attached to a cocking lever. A retractable handover latch operatively engages the cocking arm. During the first stroke of the cocking lever, the first cocking hooks draw the bowstring past the handover latch, where the bowstring is retained in a partially drawn position. During the second stroke of the cocking lever, the second cocking hooks draw the bowstring past a trigger latch, where the bowstring is retained in a fully drawn position. When the cocking lever returns to its initial closed position, the second cocking hooks and the handover latch are retracted into the crossbow body.

21 Claims, 23 Drawing Sheets

(56) References Cited

U.S. PATENT DOCUMENTS

| | | | |
|---|---|---|---|
| 9,766,032 | B1 | 9/2017 | Chang |
| 10,378,853 | B1 | 8/2019 | Liu |
| 10,495,403 | B1 | 12/2019 | Liu |

OTHER PUBLICATIONS

International Search Report and Written Opinion dated Aug. 2, 2022, from Applicant's counterpart International Patent Application No. PCT/US2022/28171.

* cited by examiner

MULTI-STROKE LEVER ACTION CROSSBOW

CROSS-REFERENCE TO RELATED APPLICATION

This application claims the benefit of, and priority to, U.S. Provisional Patent Application No. 63/185,700, filed on May 7, 2021, which is incorporated herein by reference in its entirety.

FIELD OF THE INVENTION

This invention relates to weapons. More specifically, it relates to a multi-stroke lever action crossbow.

BACKGROUND

Current marketplace has several models of pistol crossbows that shoot short arrows, commonly referred to as "bolts." One type of a pistol crossbow is known as a break-action crossbow, originally designed by the company named BARNETT and sold under the COMMANDO trademark. A break-action crossbow generally functions in the following manner: a cocking mechanism draws a bowstring from its rest position to its fully drawn position in one continuous stroke. The cocking mechanism involves at least one longitudinal arm terminating in a hook, wherein the arm is pivotally attached to the rear stock portion of the crossbow. To cock the crossbow, a user rotates the rear stock in a downward direction relative to the body of the crossbow. This breaking motion causes the arm to longitudinally translate along the body crossbow. As the arm moves back relative to the crossbow body, the hook draws the bowstring.

One disadvantage of the currently known break-action pistol crossbow is that the cocking method demands a high degree of strength from the user. To reduce the amount of force needed to cock such crossbow, many manufacturers limit the amount of bowstring draw weight, which, in turn, limits the range and accuracy of the crossbow. Furthermore, the cocking arms are generally positioned outside of the crossbow track, and, therefore, may present a safety concern and be prone to damage.

Accordingly, what is needed is a break-action crossbow having an improved cocking mechanism that alleviates the amount of effort a user must exert to cock the crossbow.

BRIEF DESCRIPTION OF THE DRAWING VIEWS

DETAILED DESCRIPTION OF SELECTED EMBODIMENTS

In the following detailed description of the preferred embodiment, reference is made to the accompanying drawings, which form a part hereof, and within which specific embodiments are shown by way of illustration by which the invention may be practiced. It is to be understood that other embodiments may be utilized and structural changes may be made without departing from the scope of the invention.

Disclosed herein is a multi-stroke lever action crossbow including a first hook, a retractable second hook, and a retractable handover latch. In a first rotation cycle of a cocking lever, the first hook engages and pulls the bowstring to a partially drawn position in which the retractable handover latch retains the bowstring. In a second rotation cycle of the cocking lever, the second hook engages and pulls the bowstring to a fully drawn position in which a trigger latch retains the bowstring. FIGS. 1-25 illustrate embodiments of the multi-stroke lever action crossbow.

Figure 1:
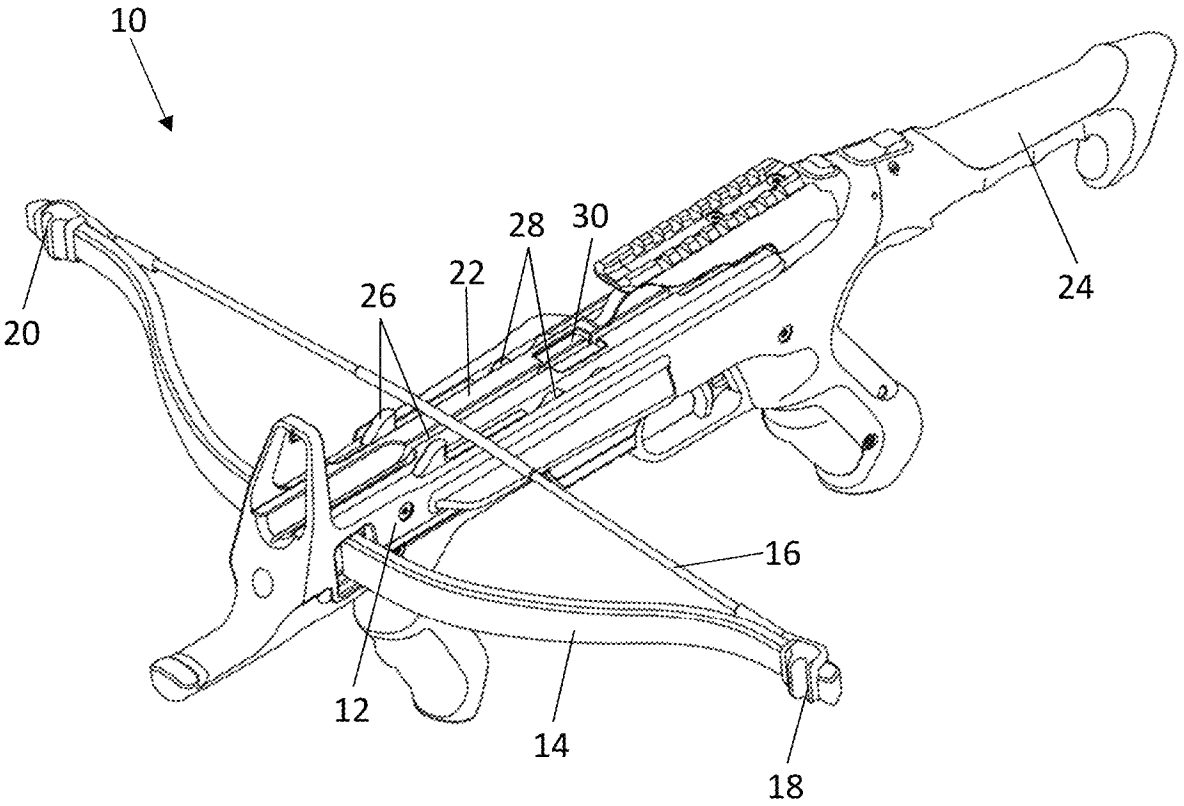
FIG. 1 is a perspective view of a lever action crossbow in a default position.

FIG. 1 illustrates lever action crossbow 10 in a default position. Crossbow 10 includes body 12, prod 14 affixed to body 12, and bowstring 16 stretched between first end 18 and second end 20 of prod 14. The top surface of body 12 forms flight rail 22, along which bowstring 16 travels when crossbow 10 is cocked and shot. Crossbow 10 further includes cocking lever 24, which is operatively connected to body 12 and selectively movable relative to body 12. In one embodiment, cocking lever 24 is formed by a rear portion of the stock. First hooks 26 and second hooks 28 are slidingly connected to body 12. First hooks 26 protrude above flight rail 22. Second hooks 28 and handover latch 30 are retractable. In the illustrated embodiment, crossbow 10 includes a pair of first hooks 26 and a pair of second hooks 28. In certain alternate embodiments, crossbow 10 may include only one first hook 26 and/or only one second hook 28.

The default position shown in FIG. 1 is the initial, uncocked configuration of crossbow 10. In this position, cocking lever 24 is in a closed position, which places each of second hooks 28 and handover latch 30 in a retracted position in which these components are disposed below flight rail 22. Also in this position, the first hooks 26 are positioned forward of bowstring 16, which is in its initial resting position.

Figure 2:
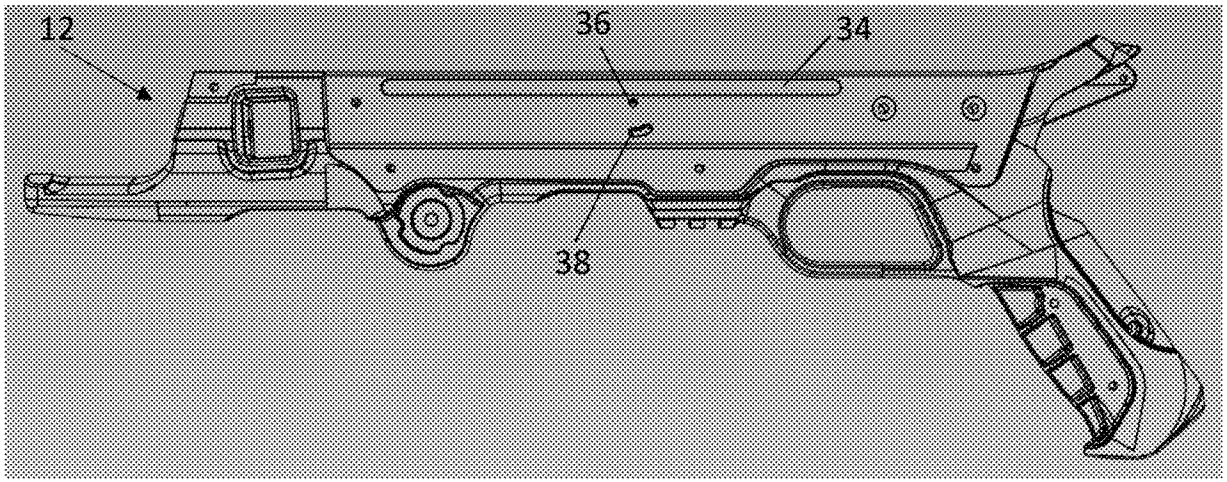
FIG. 2 is a side view of a body of the lever action crossbow.
Figure 3:
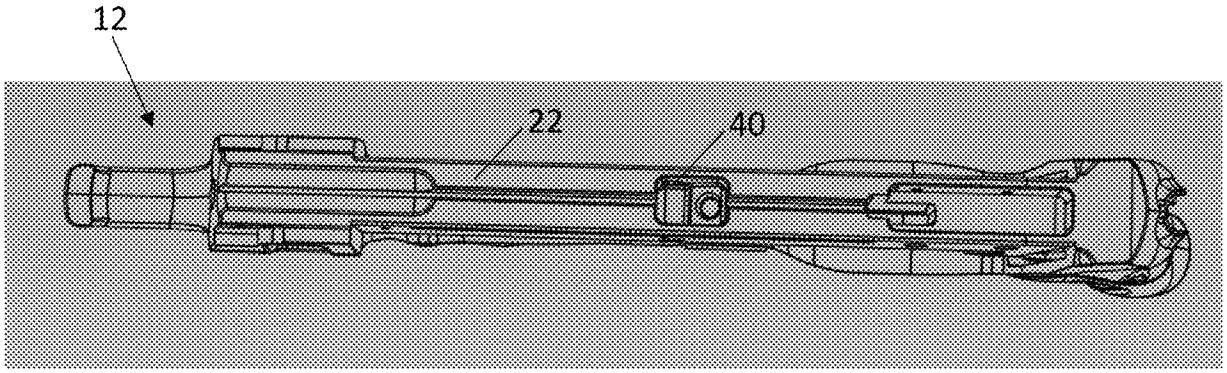
FIG. 3 is a top view of the body of the lever action crossbow.

With reference to FIGS. 2 and 3, each side of body 12 of crossbow 10 may include longitudinal groove 34, opening 36, and handover latch guide slot 38. Cavity 40 within body 12 is open to flight rail 22.

Figure 4:
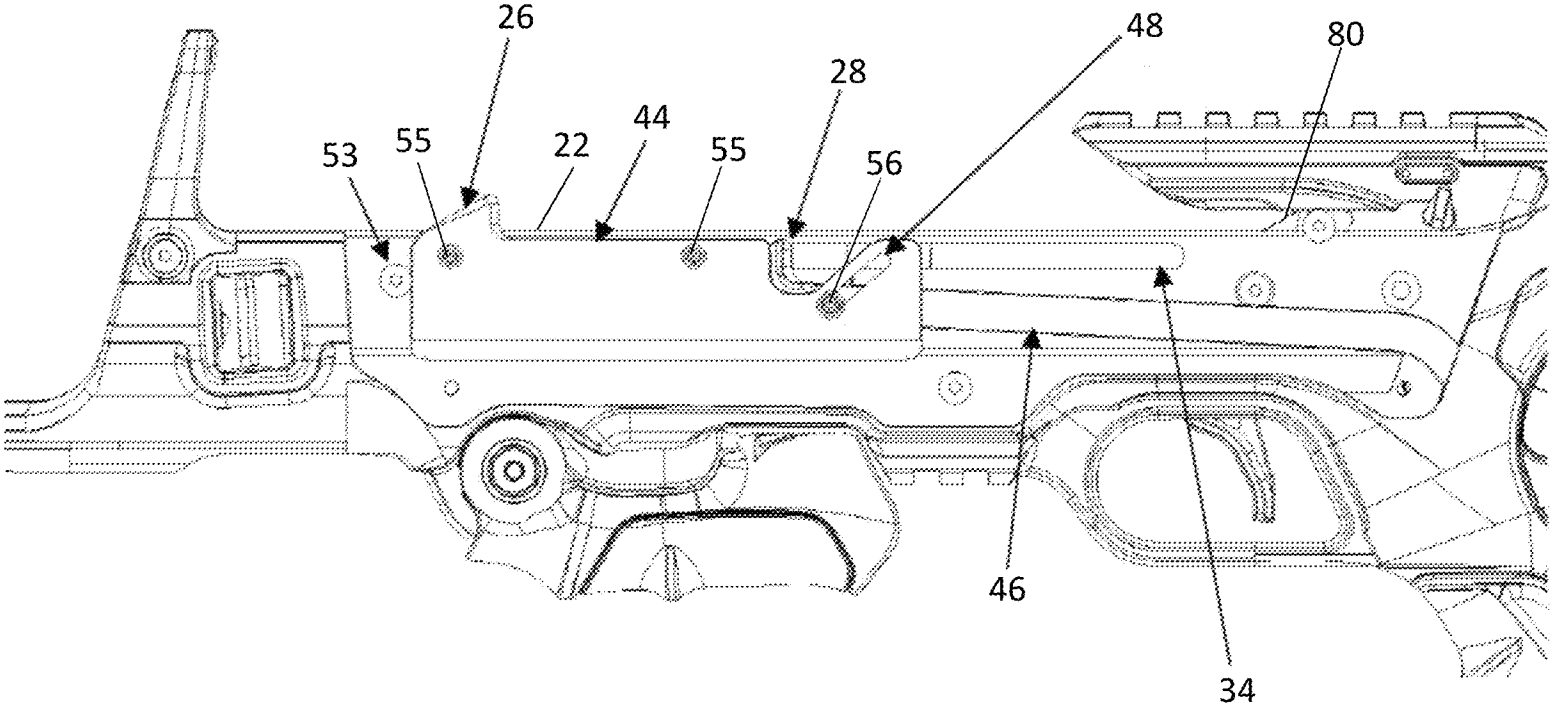
FIG. 4 is a partial side view of the lever action crossbow.
Figure 5:
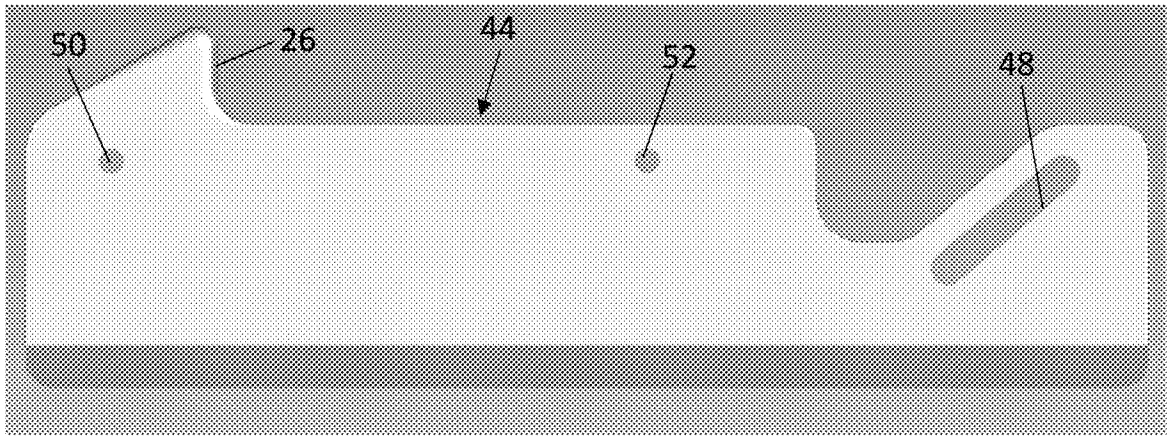
FIG. 5 is a side view of a cocking link of the lever action crossbow.
Figure 6:
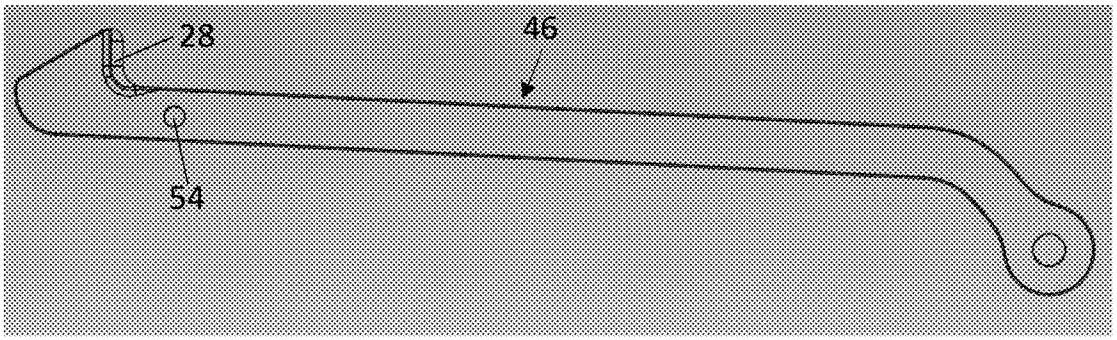
FIG. 6 is a side view of a cocking arm of the lever action crossbow.

Referring to FIGS. 4-6, crossbow 10 may further include a cocking link 44 and a cocking arm 46 on each side of body 12. Each cocking link 44 may include first hook 26 near a forward end and cocking arm guide slot 48 near a rearward end. Each cocking link 44 may also include apertures 50 and 52. A forward stop 53 may be secured to each side of body 12 and configured to engage the forward end of one of the cocking links 44 in order to limit the forward movement of the cocking link 44. Each cocking arm 46 may include a second hook 28 and aperture 54 near a forward end. As shown in FIG. 4, each cocking arm 46 may be disposed between body 12 and one of the cocking links 44. Sliding pins 55 may be partially disposed within longitudinal groove 34 of body 12 and through apertures 50 and 52 of each cocking link 44. In this way, sliding pins 55 may slidingly connect the cocking links 44 to body 12. Pin 56 may be secured through aperture 54 of each cocking arm 46 and slidingly disposed through cocking arm guide slot 48 of each cocking link 44. In this way, pins 56 operatively connect cocking links 44 to cocking arms 46, thereby operatively connecting first hooks 26 to second hooks 28. The assembly formed by sliding pins 55, cocking link 44, and pin 56 may slidingly connect each cocking arm 46 and second hook 28 to body 12.

Figure 7:
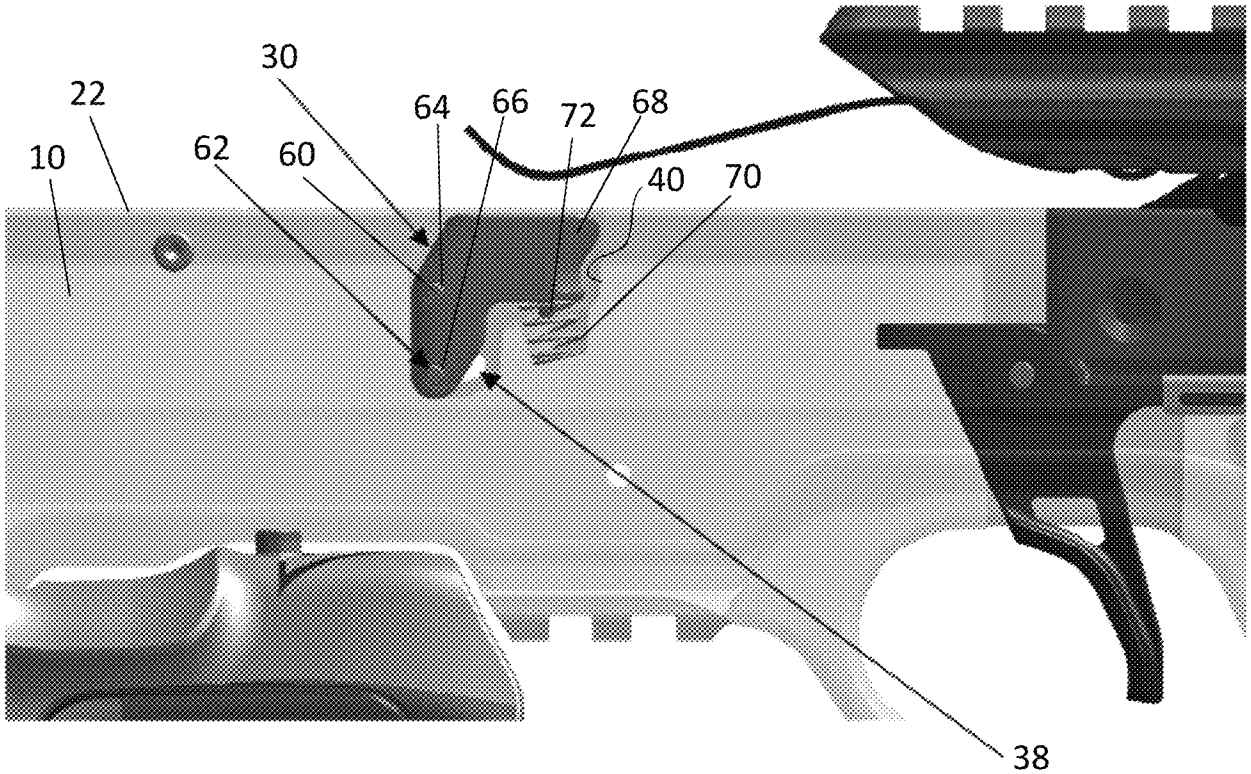
FIG. 7 is a partial cutaway view of the lever action crossbow showing a handover latch disposed within a cavity in the body of the crossbow.
Figure 8:
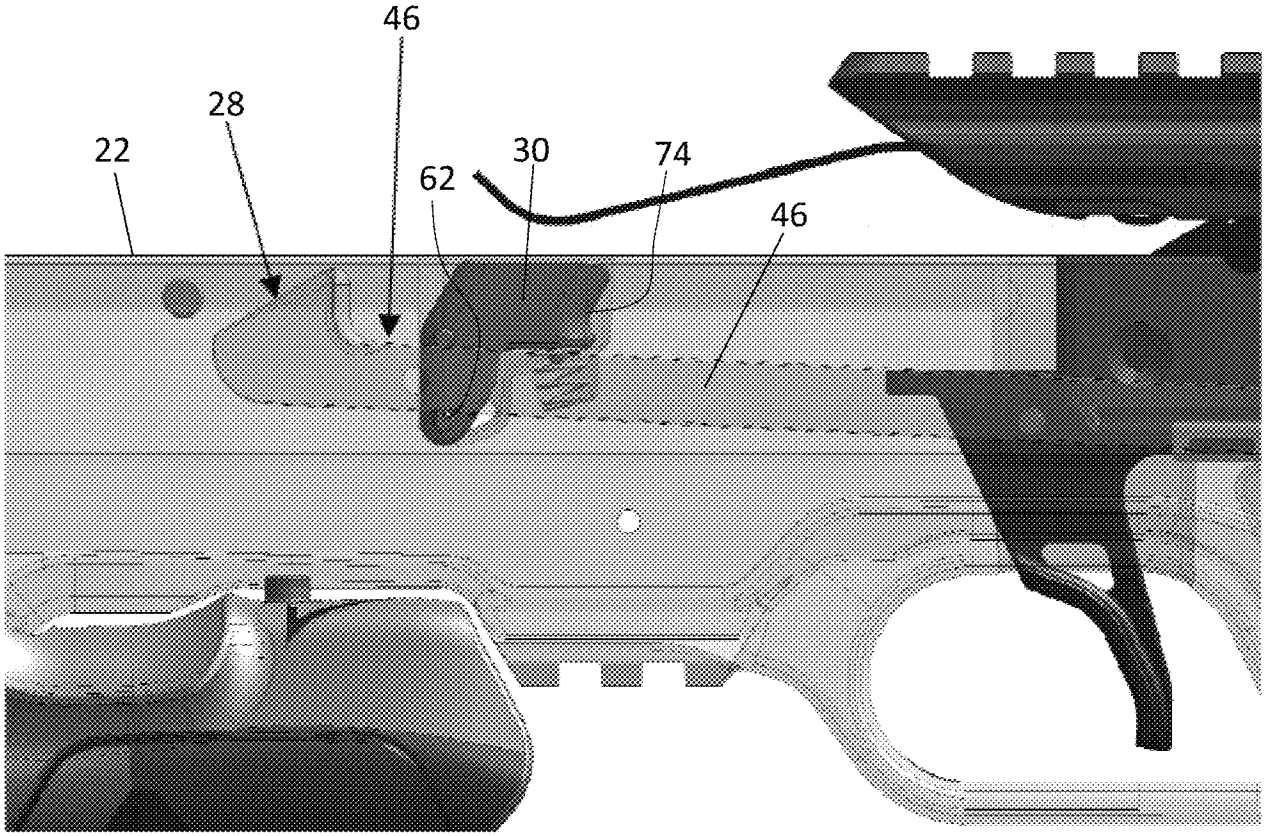
FIG. 8 is a partial cutaway view of the lever action crossbow showing a cocking arm and the handover latch of the crossbow.

FIGS. 7 and 8 show the placement of handover latch 30 within cavity 40 of body 12. Pins 60 and 62 may be disposed through apertures 64 and 66 of handover latch 30, respectively. Pins 60 and 62 may protrude beyond both side surfaces of handover latch 30. Pin 60 may be configured to extend into openings 36 on both sides of body 12 without extending past the outer side surfaces of body 12. Pin 62 may be configured to extend through handover latch guide slots 38 on both sides of body 12 and to extend a distance beyond the outer side surfaces of body 12 to engage a lower surface of cocking arm 46 as shown in FIG. 8. A rearward end 68 of handover latch 30 may be biased in an upward direction. For example, spring 70 may be positioned between a lower surface of the rearward end 68 of handover latch 30 and a lower surface of cavity 40. Pin 60 may form a pivot point for handover latch 30 through its engagement with openings 36 in body 12 when spring 70 forces the rearward end 68 of handover latch 30 in an upward direction. In one embodiment, handover latch 30 includes a spring protrusion 72 extending from the lower surface of rearward end 68. Spring protrusion 72 may be configured to receive an upper end of spring 70 for alignment. Rearward end 68 of handover latch 30 may include latch surface 74 (as shown in FIG. 8). Handover latch 30 may be retained in the retracted position shown in FIGS. 7-8 by the engagement of pin 62 of handover latch 30 with the lower surface of cocking arm 46 on each side of body 12.

Figure 9:
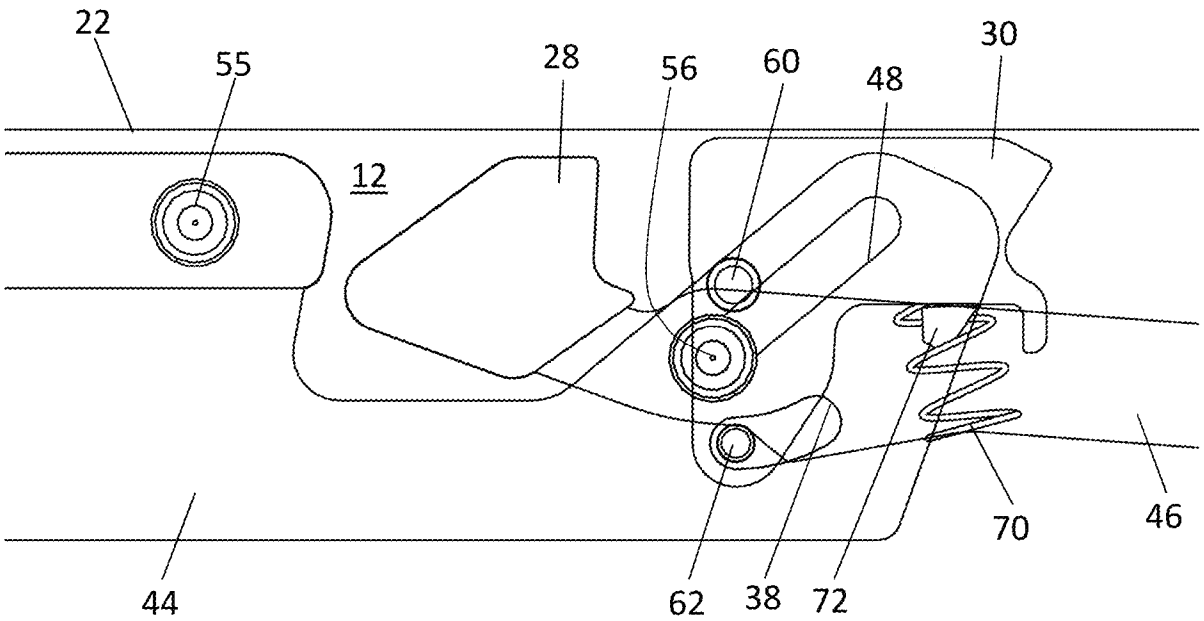
FIG. 9 is a schematic view of the cocking link, cocking arm, handover latch, and body of the lever action crossbow, with a second hook and the handover latch in retracted positions.

FIG. 9 depicts the interaction of handover latch 30, cocking arm 46, and cocking link 44 on each side of body 12 when second hooks 28 are in the retracted position and handover latch 30 is in the retracted position, such as when crossbow 10 is in the default position (shown in FIG. 1). The position of second hooks 28 and handover latch 30 are defined by the position of cocking lever 24 (shown in FIG. 1) due to the operative connection between cocking lever 24 and cocking arms 46. With cocking lever 24 in the fully closed position (shown in FIG. 1), pin 56 of each cocking arm 46 is retained and immobilized in the lower end of cocking arm guide slot 48 of each cocking link 44, thereby retaining second hooks 28 in the retracted position in which second hooks 28 are completely disposed below flight rail 22. In this position, the lower surface of each cocking arm 46 engages pin 62 of handover latch 30 to retain and immobilize pin 62 at the lower end of each handover latch guide slot 38, thereby retaining handover latch 30 in the retracted position shown in FIG. 9. In the retracted position, handover latch 30 is completely disposed within cavity 40 of body 12 and completely below flight rail 22. In this way, the interaction of handover latch 30, cocking arm 46, and cocking link 44 on each side of body 12 causes second hooks 28 and handover latch 30 to move into and/or remain in the retracted positions when cocking lever 24 is in the fully closed position shown in FIG. 1. Additionally, this interaction causes first hooks 26 (shown in FIGS. 1 and 4) and cocking links 44 to remain in a forward position when cocking lever 24 is in the fully closed position shown in FIG. 1.

Figure 10:
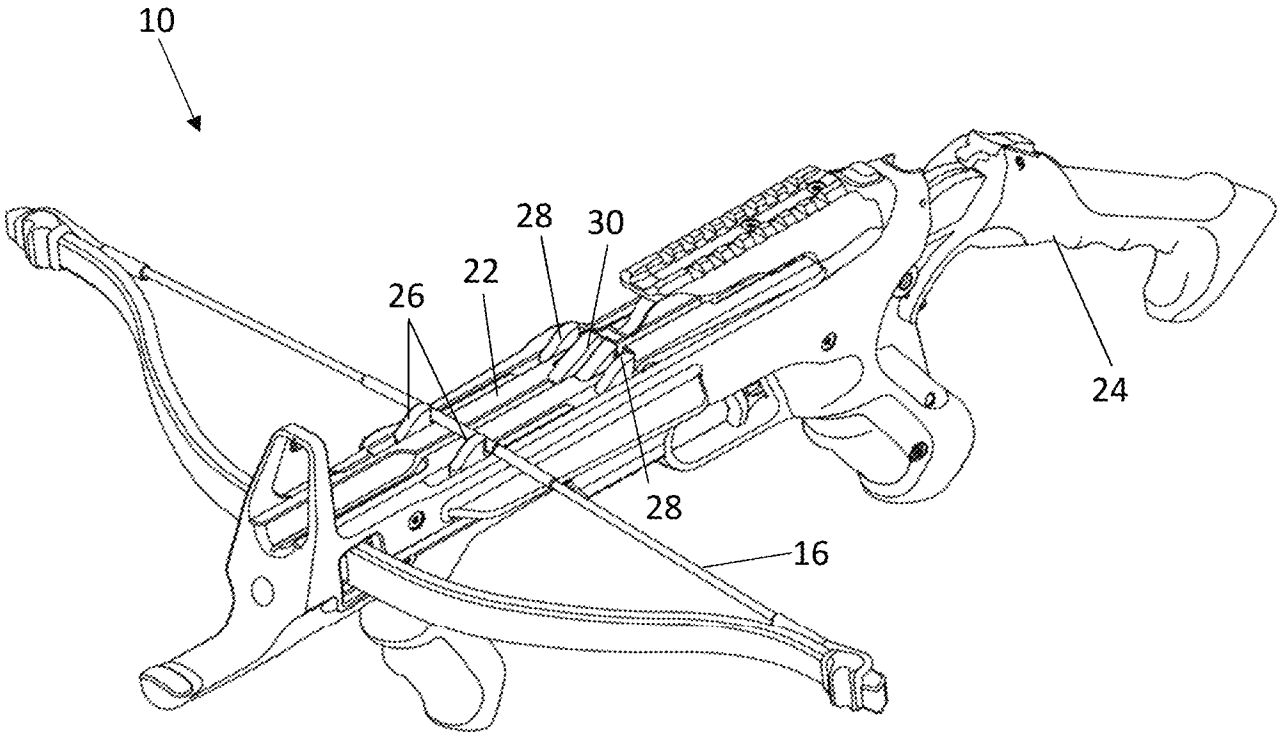
FIG. 10 is a perspective view of the lever action crossbow with a cocking lever beginning a first rotation cycle.
Figure 11:
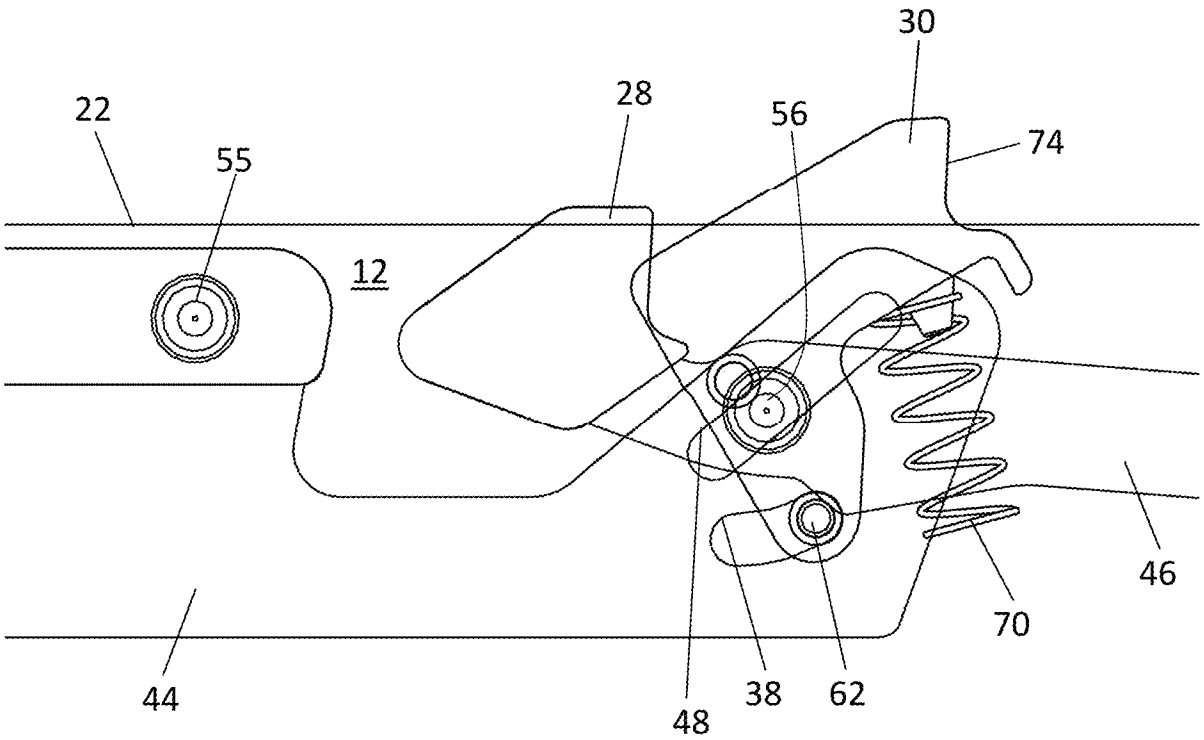
FIG. 11 is a schematic view of the cocking link, cocking arm, handover latch, and body of the lever action crossbow, with the second hook and the handover latch in an intermediate position.
Figure 12:
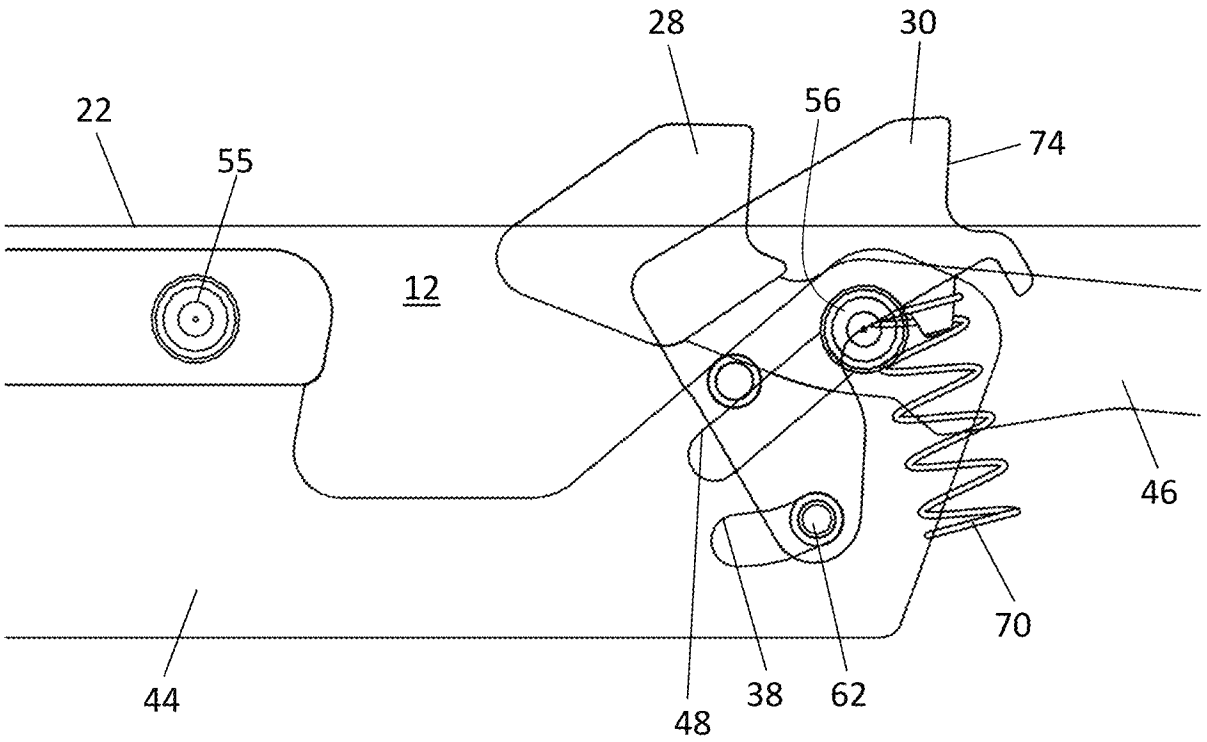
FIG. 12 is a schematic view of the cocking link, cocking arm, handover latch, and body of the lever action crossbow, with the second hook and the handover latch in an extended position.

With reference now to FIGS. 10-12, a first rotation cycle of cocking lever 24 begins with a downward rotation of cocking lever 24 from its fully closed position (shown in FIG. 1) relative to body 12. This rotation of cocking lever 24 pulls cocking arms 46 on both sides of body 12 in a rearward direction. The interaction of pins 56 of cocking arms 46 with cocking arm guide slots 48 moves second hooks 28 at the forward end of cocking arms 46 in an upward direction as cocking arms 46 move in the rearward direction. The upward movement of cocking arms 46 releases pin 62 of handover latch 30, which allows the biasing force of spring 70 to rotate handover latch 30 into an extended position (shown in FIGS. 10-12). In the extended position of handover latch 30, latch surface 74 is disposed above flight rail 22 and pin 62 is positioned at an upward end of handover latch guide slots 38 of body 12. The rearward movement of cocking arms 46 moves second hooks 28 in an upward direction as pins 56 slides upward and rearward within cocking arm guide slots 48 of cocking links 44 until pins 56 reach the upper ends of cocking arm guide slots 48, thereby placing second hooks 28 in the extended position (shown in FIGS. 10 and 12) in which second hooks 28 protrude beyond flight rail 22 of body 12. In other words, at the beginning of the first rotation cycle of cocking lever 24, cocking links 44 remain stationary while pins 56 move within the upward-sloping cocking hook guide slots 48. With pins 56 in the upper ends of cocking arm guide slots 48, further rotation of cocking lever 24 and further rearward movement of cocking arms 46 pulls second hooks 28, along with cocking links 44 and first hooks 26 in a rearward direction as pins 55 slide within longitudinal grooves 34 of body 12. The rearward movement of first hooks 26 causes first hooks 26 to engage bowstring 16 in its initial resting position as shown in FIG. 1.

Figure 13:
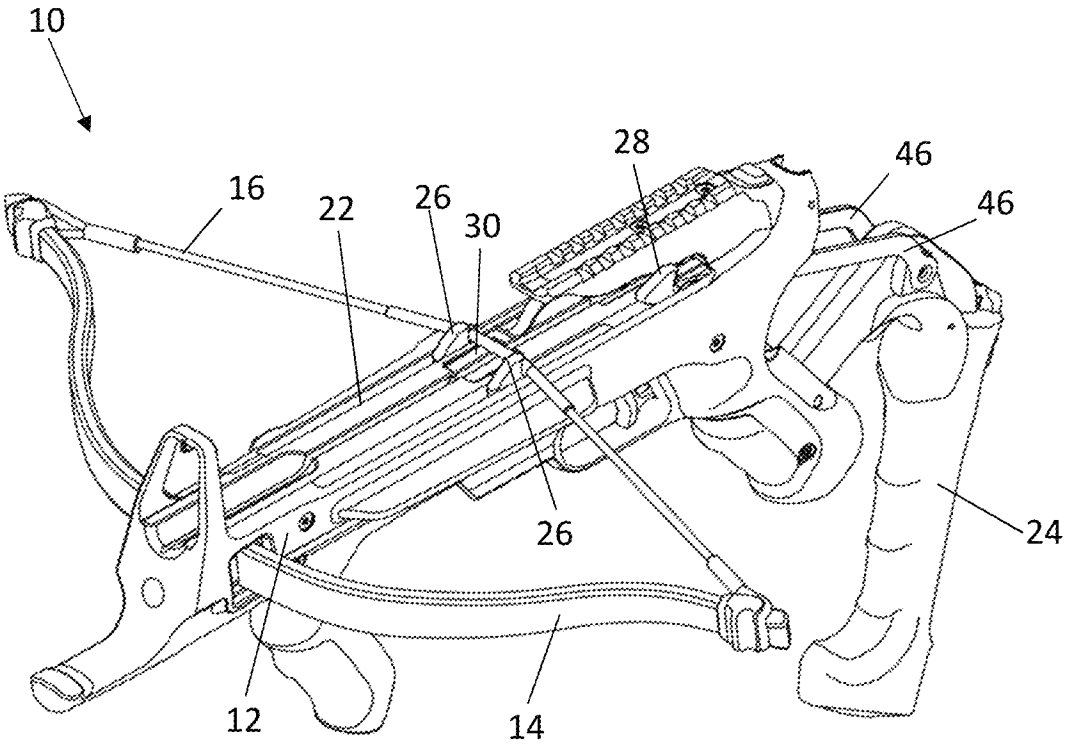
FIG. 13 is a perspective view of the lever action crossbow with the cocking lever continuing the first rotation cycle as a bowstring slides over the handover latch.

Referring now to FIG. 13, the first rotation cycle of cocking lever 24 continues as cocking lever 24 approaches a fully rotated position. FIG. 13 shows the pivotal connection of cocking arms 46 to cocking lever 24. The continued rotation of cocking lever 24 draws cocking arms 46 and cocking links 44 in the rearward direction, which moves first hooks 26 and second hooks 28 in the rearward direction relative to body 12. As first hooks 26 move further in the rearward direction, bowstring 16 is drawn from its initial resting position in the rearward direction along with first hooks 26. As bowstring 16 slides over handover latch 30, the force exerted by bowstring 16 onto a forward surface of handover latch 30 causes handover latch 30 to move into the retracted position against the biasing force of spring 70.

Figure 14:
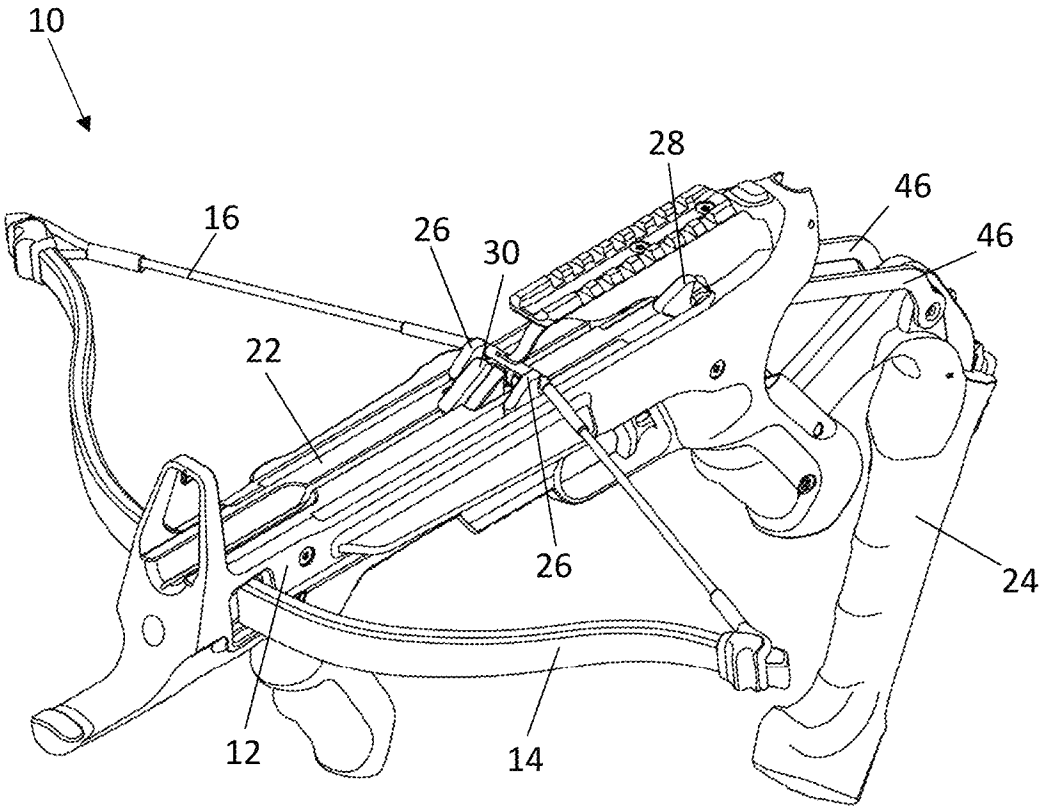
FIG. 14 is a perspective view of the lever action crossbow with the cocking lever continuing the first rotation cycle as the bowstring moves past the handover latch.

FIG. 14 shows cocking lever 24 in the fully rotated position during the first rotation cycle. As cocking lever 24 transitions into the fully rotated position, first hooks 26 and second hooks 28 continue to slide in the rearward direction relative to body 12 until first hooks 26 move past handover latch 30. In this position, bowstring 16 clears the handover latch 30, thereby allowing the biasing force of spring 70 to force handover latch 30 to return to the extended position in which latch surface 74 (shown in FIG. 8) protrudes beyond flight rail 22 of body 12. At this point, bowstring 16 is positioned behind handover latch 30 in the extended position.

Figure 15:
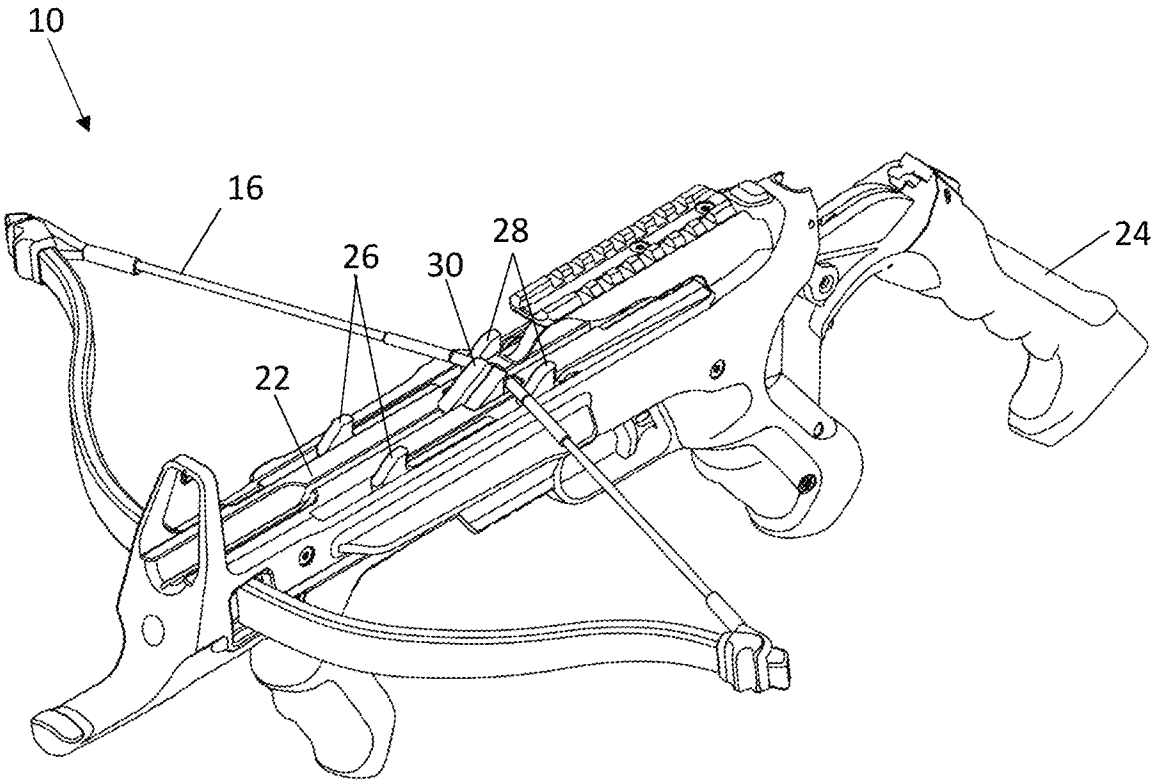
FIG. 15 is a perspective view of the lever action crossbow with the cocking lever continuing the first rotation cycle as the first hooks and second hooks slide in a forward direction.

With reference to FIG. 15, the first rotation cycle of cocking lever 24 continues as cocking lever 24 rotates in an upward direction from the fully rotated position. This upward rotation begins the return of cocking lever 24 to the closed position. As cocking lever 24 rotates upward, first hooks 26 and second hooks 28 slide forward relative to body 12. Handover latch 30 in the extended position retains bowstring 16 in a partially drawn position. Accordingly, handover latch 30 is configured to remain in the extended position when bowstring 16 exerts a force on the latch surface 74 of handover latch 30.

Figure 16:
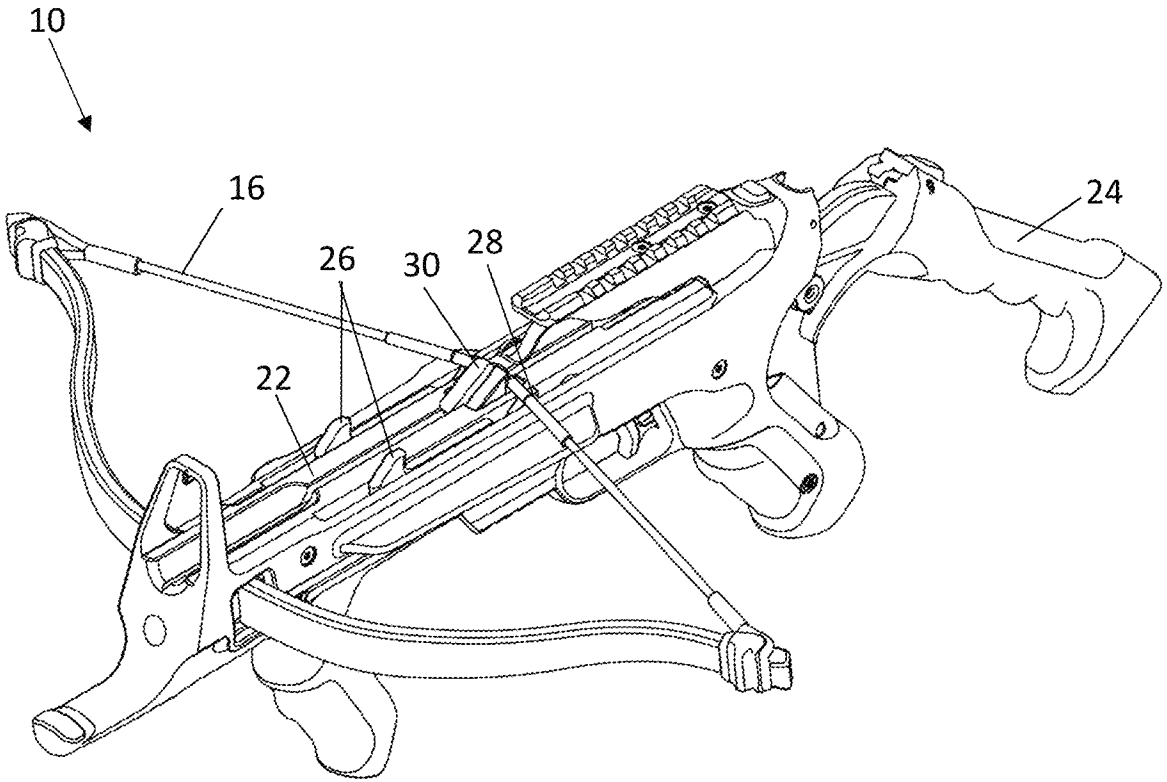
FIG. 16 is a perspective view of the lever action crossbow with the cocking lever continuing the first rotation cycle as the second hooks slide under the bowstring.
Figure 17:
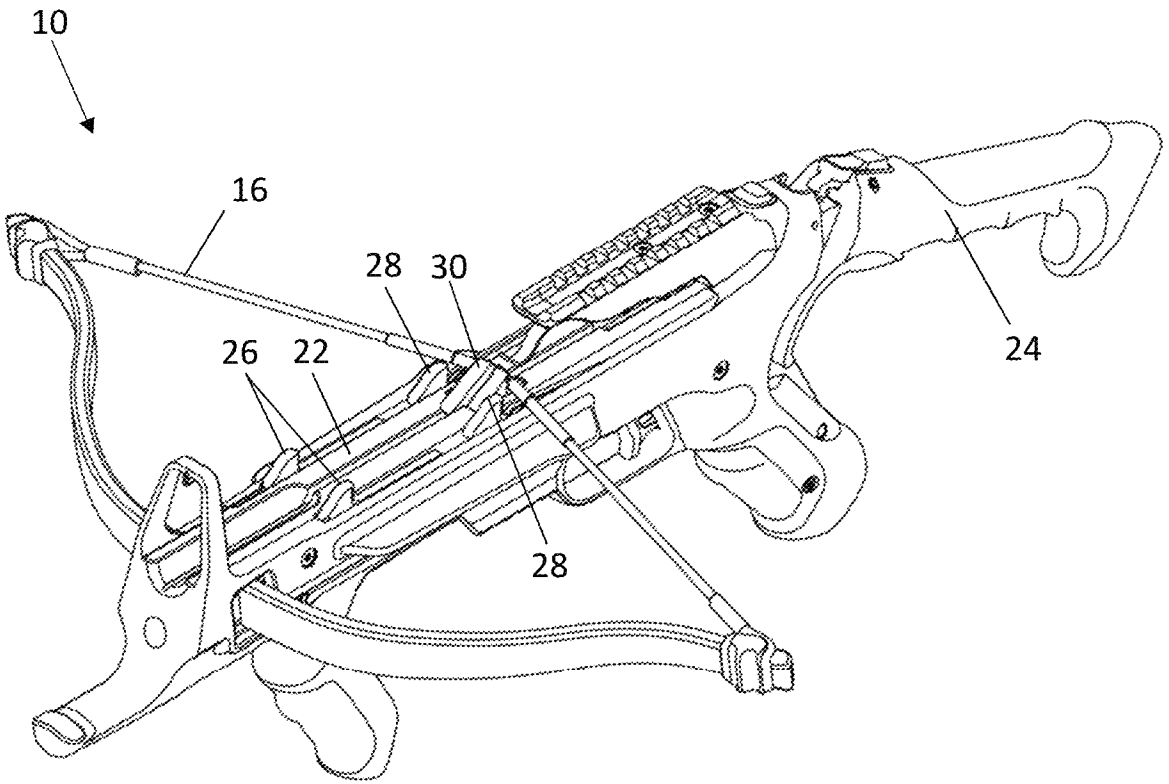
FIG. 17 is a perspective view of the lever action crossbow with the cocking lever completing the first rotation cycle as the second hooks slide forward past the bowstring and handover latch.

Referring now to FIGS. 16 and 17, as cocking lever 24 continues the upward rotation in the first rotation cycle, first hooks 26 and second hooks 28 continue to move in the forward direction relative to body 12. As cocking lever 24 approaches the fully closed position, second hooks 28 retreat into body 12 in the retracted position in which second hooks 28 do not protrude beyond flight rail 22, as shown in FIG. 16. Specifically, second hooks 28 are configured to move from the extended position into the retracted position when bowstring 16 exerts a force on the forward surface of second hooks 28 while second hooks 28 are sliding forward. This feature enables second hooks 28 to translate forward past bowstring 16 in the partially drawn position without disturbing the position of bowstring 16. At the end of the first rotation cycle of cocking lever 24, second hooks 28 are positioned forward of the bowstring 16 and handover latch 30, as shown in FIG. 17. In this way, a first rotation cycle (or "first stroke") of cocking lever 24 draws bowstring 16 from the initial resting position into the partially drawn position behind handover latch 30, as shown in FIGS. 1, 10, and 13-17.

Figure 18:
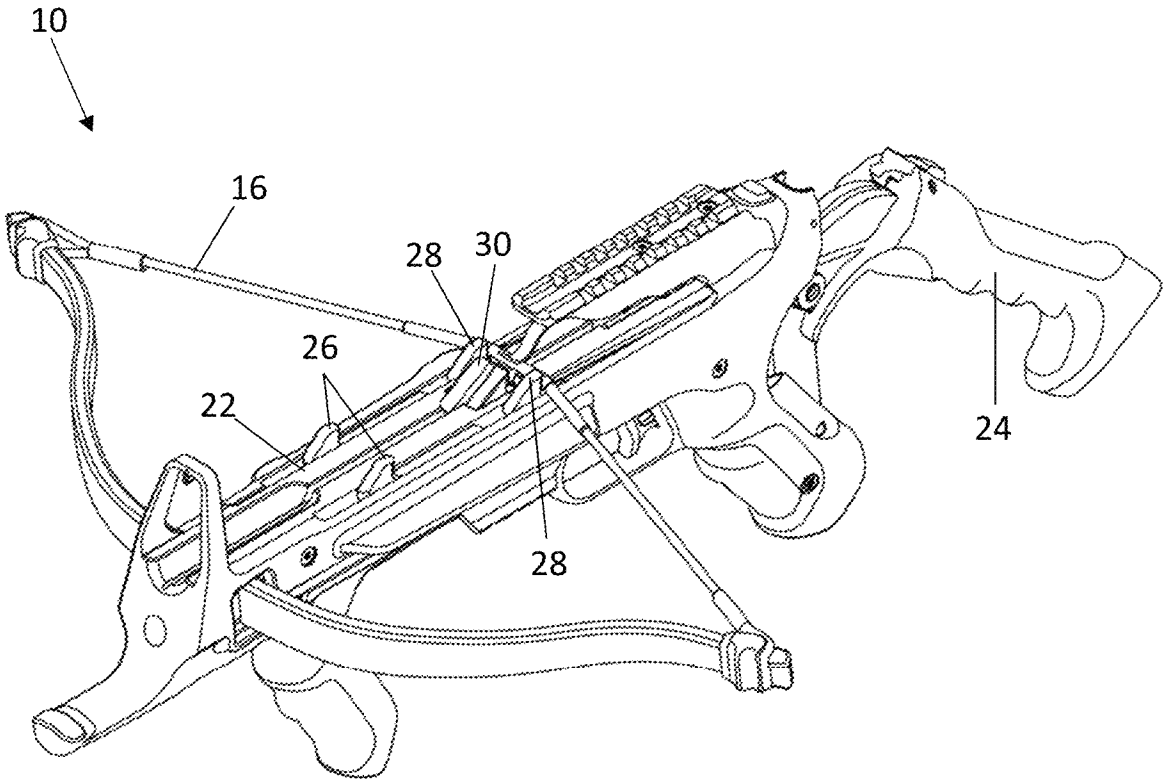
FIG. 18 is a perspective view of the lever action crossbow with the cocking lever beginning a second rotation cycle as the second hooks engage the bowstring.

With reference to FIG. 18, the second rotation cycle of cocking lever 24 begins as cocking lever 24 is rotated in a downward direction with bowstring 16 in the partially drawn position behind handover latch 30 and with second hooks 28 forward of handover latch 30. From this position, the downward rotation of cocking lever 24 draws first hooks 26 and second hooks 28 in the rearward direction, thereby causing second hooks 28 to engage bowstring 16 and begin to draw bowstring 15 in the rearward direction. Accordingly, second hooks 28 are configured to remain in the extended position when bowstring 16 exerts a force on the rearward surface of second hooks 28 to enable second hooks 28 to draw the bowstring 16 in a rearward direction.

Figure 19:
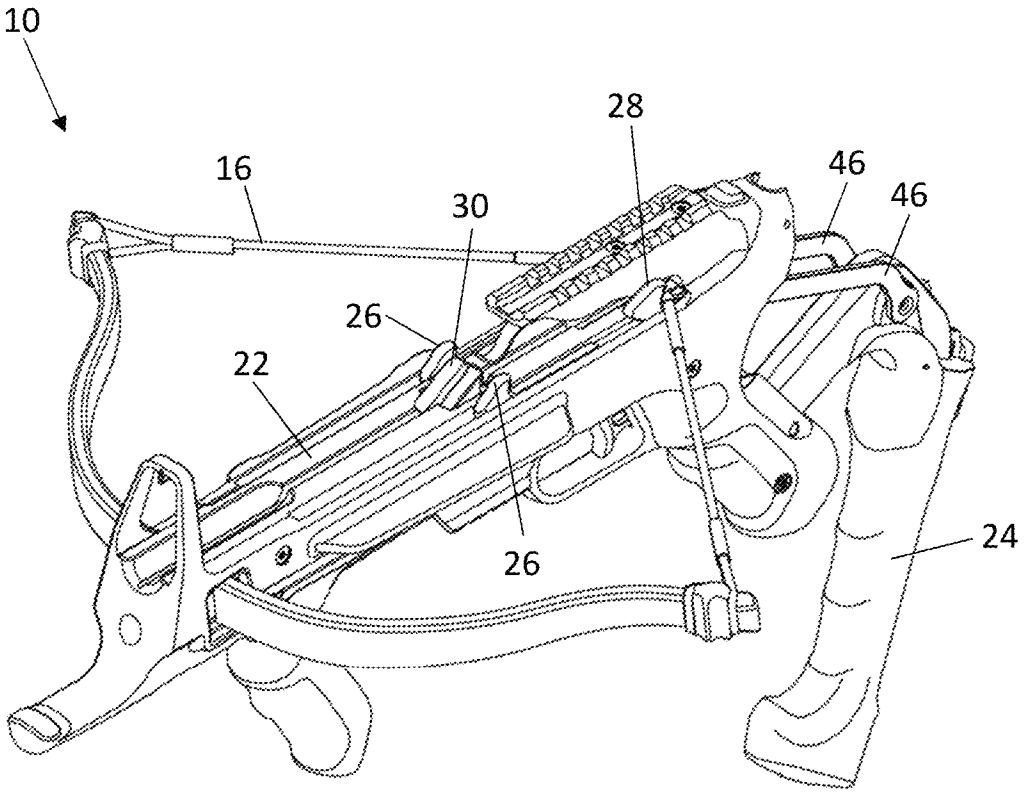
FIG. 19 is a perspective view of the lever action crossbow with the cocking lever continuing the second rotation cycle as the second hooks draw the bowstring to a trigger latch.

Referring now to FIG. 19, as cocking lever 24 continues the downward rotation into the fully rotated position in the second rotation cycle, second hooks 28 draw bowstring 16 in the rearward direction until bowstring 16 engages trigger latch 80 (shown in FIG. 4). Trigger latch 80 retains bowstring 16 in the fully drawn position shown in FIG. 19.

Figure 20:
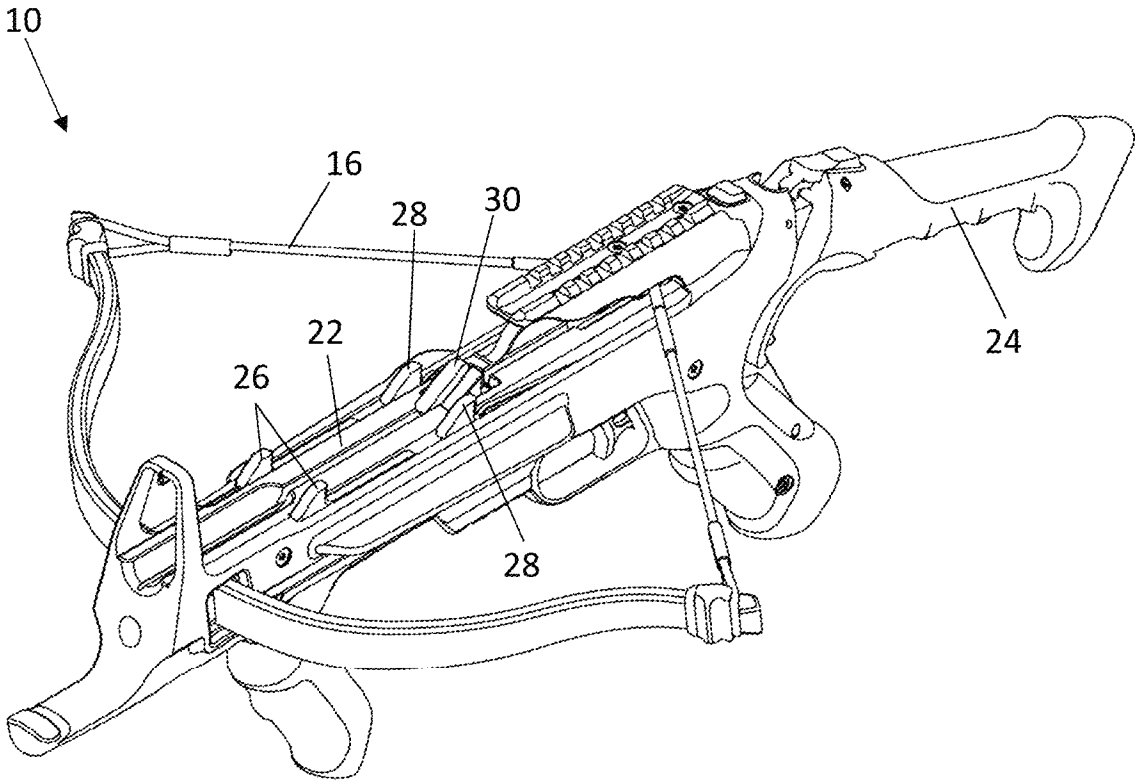
FIG. 20 is a perspective view of the lever action crossbow with the cocking lever continuing the second rotation cycle as the first hooks and the second hooks slide forward to initial positions.
Figure 21:
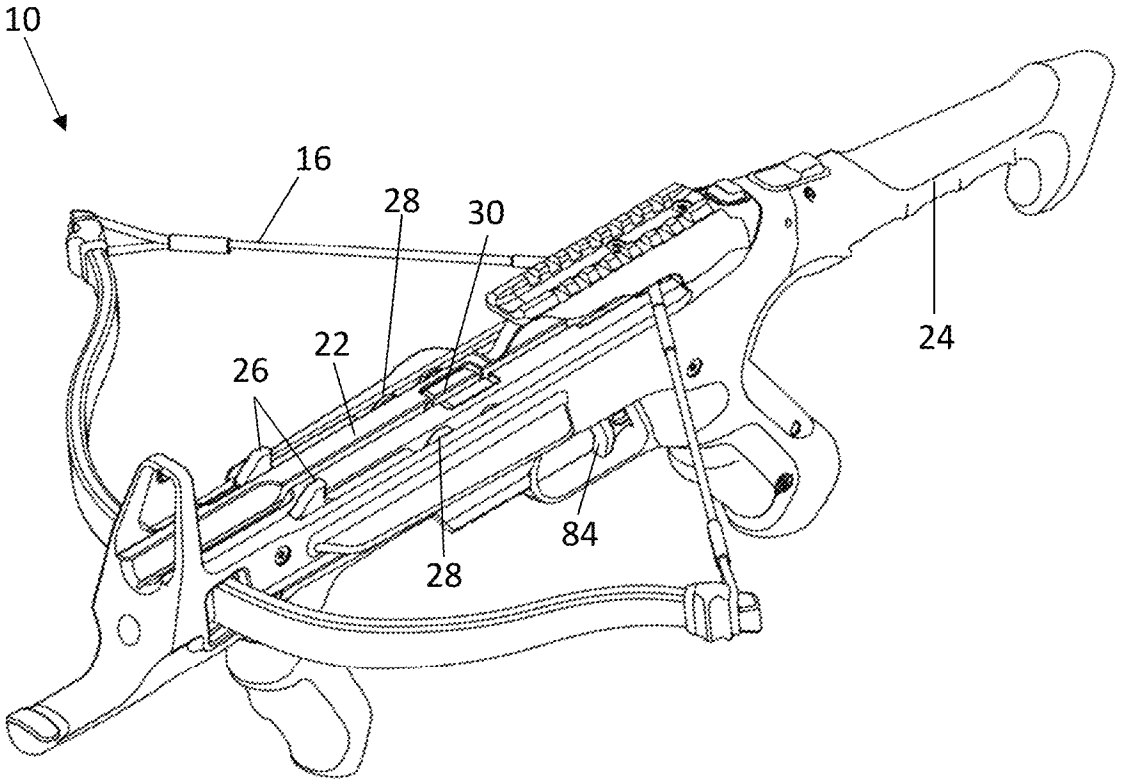
FIG. 21 is a perspective view of the lever action crossbow with the cocking lever completing the second rotation cycle as the cocking lever returns to its fully closed position and the second hooks and the handover latch return to retracted positions.
Figure 22:
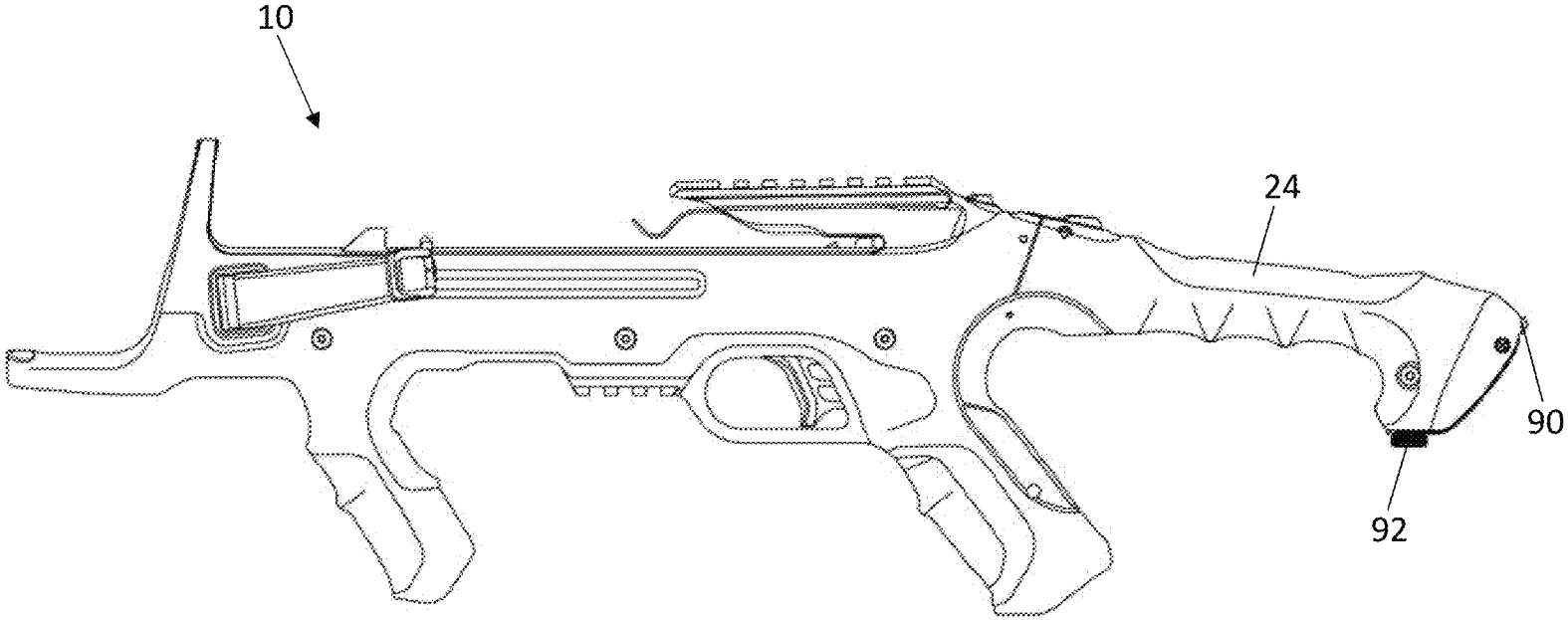
FIG. 22 is a side view of a lever action crossbow with an adjustable sling in a retracted position.

FIGS. 20 and 22 show cocking lever 24 rotating in an upward direction in the second rotation cycle. This upward rotation of cocking lever 24 causes first hooks 26 and second hooks 28 to slide forward relative to body 12, while bowstring 16 remains in the fully drawn position. Specifically, first hooks 26 slide forward until the forward end of each cocking link 44 engages one of the forward stops 53 (shown in FIG. 4). At this point, cocking links 44 remain stationary and further upward rotation of cocking lever 24 causes pins 56 of cocking arms 46 to slide downward within cocking arm guide slots 48 of cocking links 44 until reaching the lower ends thereof (as shown in FIG. 9). This downward movement of cocking arms 46 causes second hooks 28 to return to the retracted position in which second hooks 28 are disposed below flight rail 22. Additionally, the downward movement of cocking arms 46 forces pin 62 to slide downward within handover latch guide slot 38 on each side of body 12, thereby forcing handover latch 30 to return to its retracted position in which latch surface 74 is disposed below flight rail 22. In this way, returning cocking lever 24 to its fully closed position (shown in FIG. 21) at the end of the second rotation cycle returns second hooks 28 and handover latch 30 to their retracted positions, thereby leaving flight rail 22 unobstructed. At this point, crossbow 10 is cocked. In this way, a second rotation cycle (or "second stroke") of cocking lever 24 draws bowstring 16 from the partially drawn position behind handover latch 30 into the fully drawn position behind trigger latch 53, as shown in FIGS. 18-21, and places the crossbow 10 into the cocked position in which first hooks are positioned forward of the initial resting position of bowstring 16, second hooks 28 are in the retracted position, and handover latch 30 is in the retracted position. A user may position a bolt onto flight rail 22 of crossbow body 12, take aim, and pull trigger 84. Pulling trigger 84 releases bowstring 16 from trigger latch 53, thereby allowing bowstring 16 to propel the bolt out of crossbow 10.

The multi-stroke lever action crossbow described herein has a dual-stroke cocking mechanism that provides significant mechanical advantage over single stroke mechanisms. The dual-stroke cocking mechanism disclosed herein enables a user to fully draw the bowstring via twice the rotational input from the cocking lever. Accordingly, the multi-stroke lever action crossbow disclosed herein makes the crossbow significantly easier for the user to cock the crossbow by reducing the effort load and strength required. This improvement further affords an opportunity for increased crossbow draw weight, increased crossbow draw length, decreased cocking lever size and/or angle of rotation, when compared against single-stroke crossbows.

FIGS. 1-21 and the above description pertain to a dual-stroke design, which draws the bowstring back to the trigger latch in two rotation cycles of the cocking lever. However, alternate embodiments utilize three, four, or more rotation cycles or cocking stages/strokes to provide greater mechanical advantage for the user. Furthermore, the present invention is not limited to a pistol format crossbow. In alternative embodiments, a dual-stroke, or a multi-stroke lever action mechanism could be integrated into larger full-size crossbows of varied style and specification.

The drawings and the above description pertain to a cocking lever that is in the form of a break-action lever at the rear of the stock. However, in alternative embodiments, the cocking lever could be located in a different position—for example, underneath or on the side of the crossbow body—and could be used to cock the crossbow in a similar manner.

Furthermore, the drawings provided herein depict the handover latch at the halfway point of the crossbow body. However, in an alternative embodiment, the handover latch could be placed anywhere along the inside and/or outside of the crossbow body. Alternatively, the crossbow may include two or more handover latches in embodiments utilizing three or more cocking lever rotation cycles. Finally, the drawings depict that second hooks retract below the surface of the flight rail via a guide slot. However, in an alternative embodiment, the hooks may be configured to rotate out of the way of the bowstring on a pivot.

An optional feature of the present invention pertains to a retractable carrying sling. The retractable sling includes a cassette positioned within the rear stock (i.e. cocking lever) of crossbow. The cassette has a spring-loaded spool configured to retract the sling into a recess within the rear stock of the crossbow. The retractable sling further includes a locking switch that enables the user to immobilize the spool against retracting the sling into the cassette when the sling is in its deployed configuration. When the locking switch is engaged the sling does not automatically retract into the cassette. However, when the locking switch is disengaged, the sling is automatically retracted by being wound onto the spool.

Figure 23:
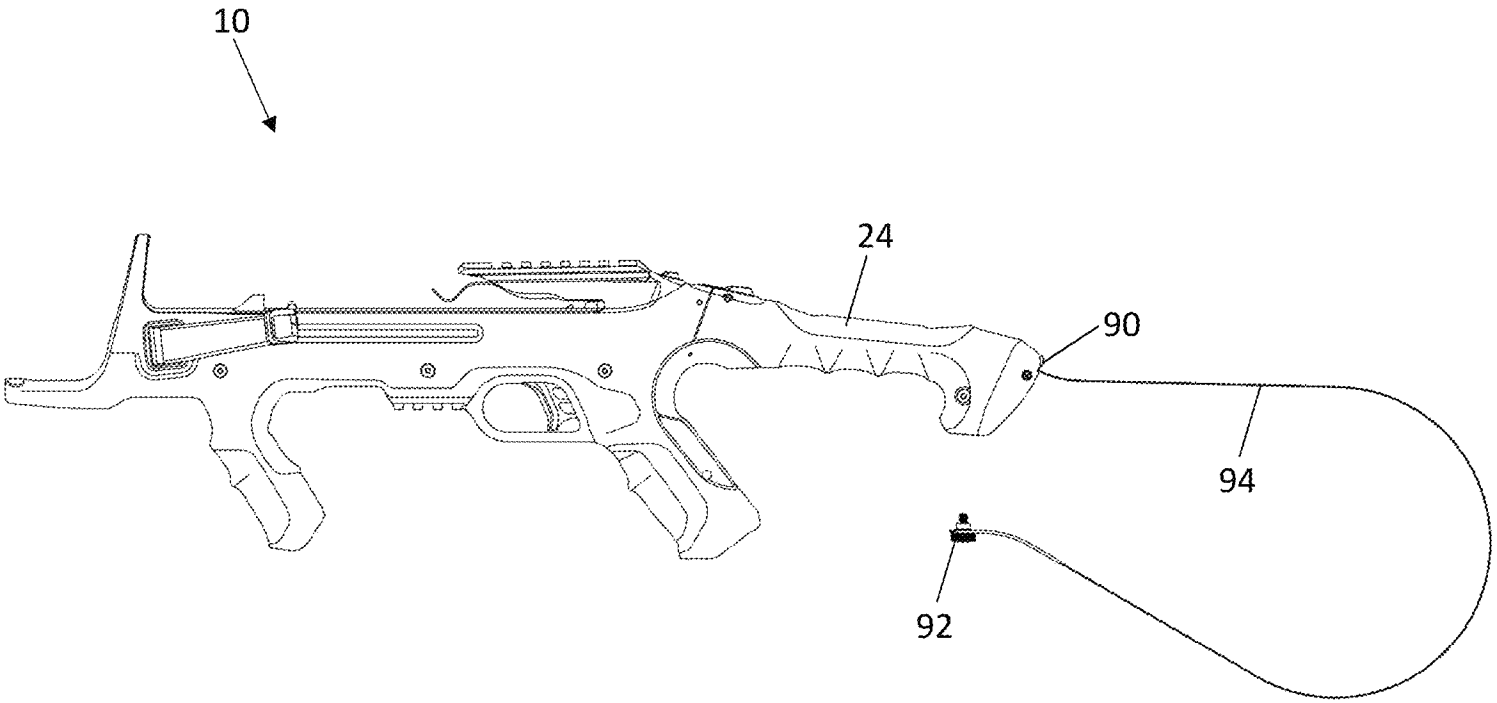
FIG. 23 is a side view of the lever action crossbow with the adjustable sling in an extended position.
Figure 24:
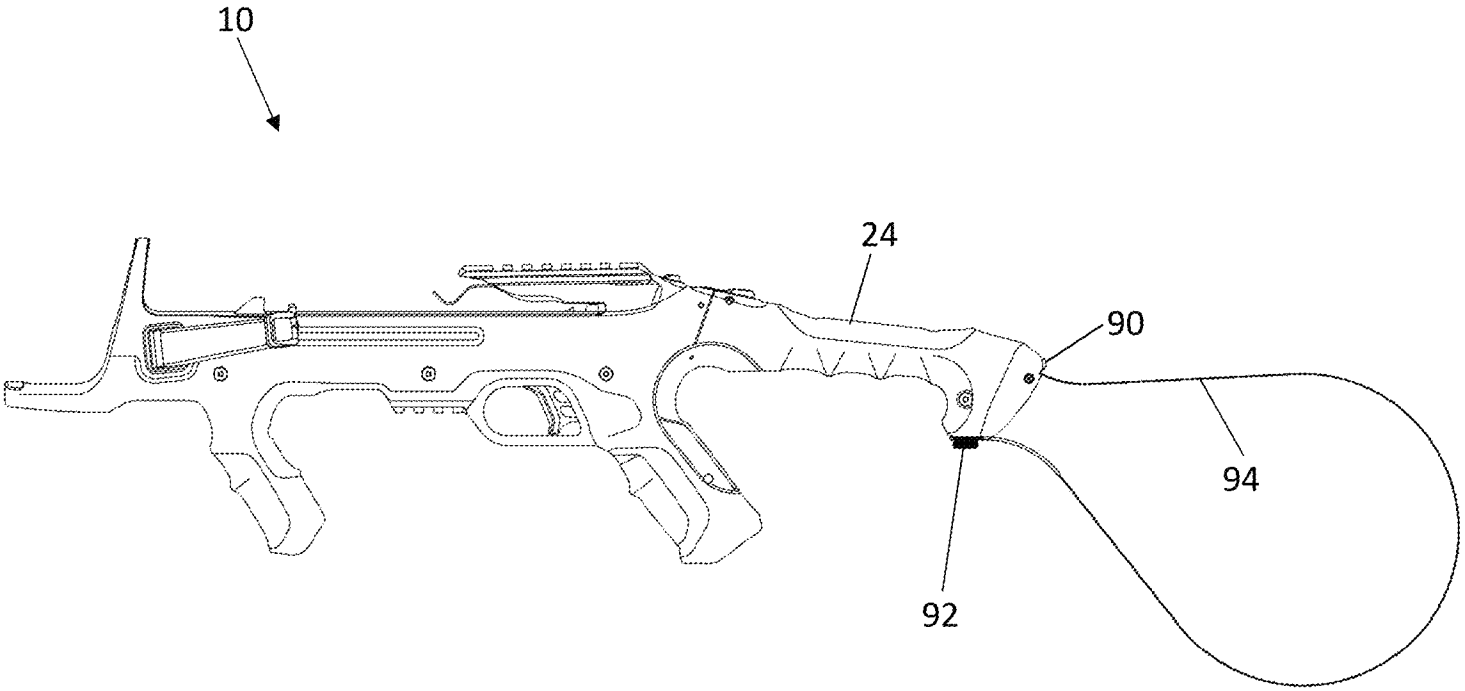
FIG. 24 is a side view of the lever action crossbow with the adjustable sling in a first shoulder strap position.

FIGS. 22-25 show one embodiment of the retractable sling. In this embodiment, crossbow 10 includes locking switch 90 and thumb screw 92. With locking switch 90 disengaged, sling 94 may be extended out of the cassette by a user as shown in FIG. 23. Locking switch 90 can then be re-engaged to lock sling 94 in position forming a rear shoulder loop as shown in FIG. 24.

Figure 25:
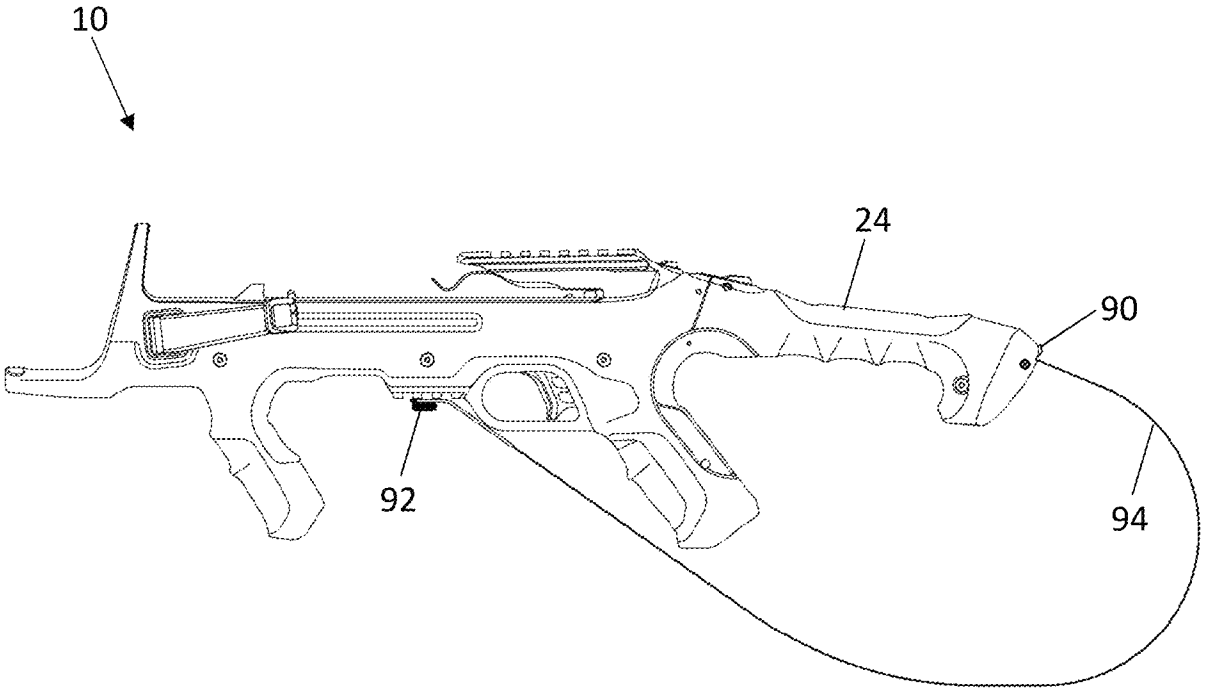
FIG. 25 is a side view of the lever action crossbow with the adjustable sling in a second shoulder strap position.

As shown in FIG. 23, the terminal end of the sling 94 has a thumb screw 92 configured to couple to one or more predetermined attachment points on the crossbow 10. FIG. 23 depicts the locking switch 90 in the disengaged position and the thumb screw 92 detached from the attachment point positioned on the cocking lever 24. FIG. 25 depicts that the user can extend the sling 94 out of the cassette by a predetermined length and then couple the thumb screw 92 to a desired attachment point. The locking switch 90 can then be re-engaged to retain the sling 94 at its desired length. The sling 94 can then be used to carry the crossbow 10. Subsequently, the user can decouple the thumb screw 92 from the attachment point, disengage the locking switch 90, and the spring-loaded spool will return the sling 94 into its retracted position depicted in FIG. 22.

Although FIGS. 22-25 depict the mounting pocket for the sling 94 at the rear of the cocking lever 24, in an alternate embodiment, the mounting pocket could be located elsewhere on the crossbow 10, such as the beneath the pistol grip, stock, or foregrip. Also, instead of a thumb screw 92, a quick detach could be used, such as a ball catch, magnetic connection or cam action connection. The retractable sling is not limited to a pistol format crossbow and could be integrated into a larger full-size crossbow in a similar manner. Furthermore, instead of the locking switch depicted in FIGS. 18-21, a sliding, twisting or push button interface could also be used to lock the sling in a similar manner.

Each device described in this disclosure may include any combination of the described components, features, and/or functions of each of the individual device embodiments. Each method described in this disclosure may include any combination of the described steps in any order, including the absence of certain described steps and combinations of steps used in separate embodiments. Any range of numeric values disclosed herein includes any subrange therein.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense. While preferred embodiments have been described, it is to be understood that the embodiments are illustrative only and that the scope of the invention is to be defined solely by the appended claims when accorded a full range of equivalents, many variations and modifications naturally occurring to those skilled in the art from a review hereof.

I claim:

1. A crossbow comprising:

a body having a flight rail;

a prod affixed to the body of the crossbow;

a bowstring stretched between a first end and a second end of the prod;

a cocking lever pivotally connected to the body;

a handover latch at least partially disposed within a cavity in the body, wherein the handover latch is configured to selectively move between a retracted position in which the handover latch is disposed below the flight rail and an extended position in which a latch surface of the handover latch protrudes above the flight rail;

a first hook slidingly connected to the body, wherein the first hook is configured to slide along the body in response to rotation of the cocking lever in a first rotation cycle to draw the bowstring from a resting position to a partially drawn position in which the bowstring engages the latch surface of the handover latch;

a second hook slidingly connected to the body, wherein the second hook is configured to selectively move between a retracted position in which the second hook is positioned below the flight rail and an extended position in which the second hook protrudes above the flight rail, and wherein the second hook is configured to slide along the body in the extended position in response to rotation of the cocking lever in a second rotation cycle to draw the bowstring from the partially drawn position to a fully drawn position in which the bowstring engages a trigger latch.

2. The crossbow of claim 1, wherein rotation of the cocking lever moves the second hook between the retracted position and the extended position, and wherein rotation of the cocking lever moves the handover latch between the retracted position and the extended position.

3. The crossbow of claim 1, wherein the second hook is configured to remain in the extended position to retain the bowstring when the bowstring exerts a force on a rearward surface of the second hook in the extended position; wherein the handover latch is configured to remain in the extended position to retain the bowstring when the bowstring exerts a force on the latch surface of the handover latch in the extended position.

4. The crossbow of claim 3, wherein the second hook is configured to move from the extended position into the retracted position when the bowstring exerts a force on a forward surface of the second hook, and wherein the handover latch is configured to move from the extended position into the retracted position when the bowstring exerts a force on a forward surface of the handover latch.

5. The crossbow of claim 1, wherein the second hook is also configured to slide along the body in response to rotation of the cocking lever in the first rotation cycle; and wherein the first hook is also configured to slide along the body in response to rotation of the cocking lever in the second rotation cycle.

6. The crossbow of claim 1, wherein the body further includes a handover latch guide slot in each of its side surfaces, and wherein the handover latch includes a pin extending through the handover latch guide slot.

7. The crossbow of claim 1, further comprising a cocking link slidingly connected to the body, wherein the first hook is disposed at a forward end of the cocking link.

8. The crossbow of claim 7, further including a forward stop extending from a side surface of the body, wherein the forward stop is configured to limit the forward movement of the cocking link as it slides along the body.

9. The crossbow of claim 7, wherein the body includes a longitudinal groove in a side surface, and wherein the cocking link includes one or more sliding pins that are slidingly engaged with the longitudinal groove.

10. The crossbow of claim 7, further comprising a cocking arm pivotally connected to the cocking lever, wherein the cocking arm is operatively connected to the cocking link, wherein the second hook is disposed at a forward end of the cocking arm.

11. The crossbow of claim 10, wherein the handover latch is biased in an upward direction, and wherein the cocking arm limits the upward movement of a rearward end of the handover latch to retain the handover latch in the retracted position when the cocking lever is in a fully closed position.

12. The crossbow of claim 10, wherein the cocking link further includes a cocking arm guide slot, and wherein the cocking arm includes a pin extending through the cocking arm guide slot.

13. The crossbow of claim 1, further comprising a retractable sling configured to be extended to form a carrying handle for the crossbow.

14. A crossbow comprising:

a body having a flight rail;

a prod affixed to the body of the crossbow;

a bowstring stretched between a first end and a second end of the prod;

a cocking lever pivotally connected to the body;

a handover latch at least partially disposed within a cavity in the body, wherein the handover latch is configured to selectively move between a retracted position in which the handover latch is disposed below the flight rail and an extended position in which a latch surface of the handover latch protrudes above the flight rail;

a pair of cocking links with a first hook disposed at a forward end of each cocking link, wherein each cocking link is connected to a side of the body, wherein the cocking links are configured to slide along each side of the body to engage the bowstring with the first hooks in response to rotation of the cocking lever in a first rotation cycle to draw the bowstring from a resting position to a partially drawn position in which the bowstring engages the latch surface of the handover latch;

a pair of cocking arms with a second hook disposed at a forward end of each cocking arm, wherein each cocking arm is pivotally connected to the cocking lever and operatively connected to one of the cocking links, wherein the second hooks are configured to selectively move between a retracted position in which the second hooks are positioned below the flight rail and an extended position in which the second hooks protrude above the flight rail, and wherein the cocking arms are configured to slide along each side of the body to engage the bowstring with the second hooks in the extended position in response to rotation of the cocking lever in a second rotation cycle to draw the bowstring from the partially drawn position to a fully drawn position in which the bowstring engages a trigger latch.

15. The crossbow of claim 14, wherein rotation of the cocking lever moves the second hooks between the retracted position and the extended position; and wherein rotation of the cocking lever moves the handover latch between the retracted position and the extended position.

16. The crossbow of claim 14, wherein the second hooks are configured to remain in the extended position to retain the bowstring when the bowstring exerts a force on a rearward surface of each of the second hooks, wherein the handover latch is configured to remain in the extended position to retain the bowstring when the bowstring exerts a force on the latch surface of the handover latch.

17. The crossbow of claim 16, wherein the second hooks are configured to move from the extended position into the retracted position when the bowstring exerts a force on a forward surface of each of the second hooks; and wherein the handover latch is configured to move from the extended position into the retracted position when the bowstring exerts a force on a forward surface of the handover latch.

18. The crossbow of claim 14, wherein the handover latch is biased in an upward direction, and wherein the cocking arms limit the upward movement of a rearward end of the handover latch to retain the handover latch in the retracted position when the cocking lever is in a fully closed position.

19. A method of cocking a crossbow, comprising the steps of:

b) providing a crossbow comprising: a body having a flight rail; a prod affixed to the body of the crossbow; a bowstring stretched between a first end and a second end of the prod; a cocking lever pivotally connected to the body; a handover latch at least partially disposed within a cavity in the body, wherein the handover latch is configured to selectively move between a retracted position in which the handover latch is disposed below the flight rail and an extended position in which a latch surface of the handover latch protrudes above the flight rail; a first hook slidingly connected to the body, wherein the first hook is configured to slide along the body in response to rotation of the cocking lever; a second hook slidingly connected to the body, wherein the second hook is configured to selectively move between a retracted position in which the second hook is positioned below the flight rail and an extended position in which the second hook protrudes above the flight rail, and wherein the second hook is configured to slide along the body in the extended position in response to rotation of the cocking lever;

c) rotating the cocking lever in a first cocking cycle to slide the first hook along the body thereby transferring the bowstring from a resting position to a partially drawn position in which the bowstring engages the latch surface of the handover latch, wherein the first cocking cycle includes a downward rotation and an upward rotation relative to the body;

d) rotating the cocking lever in a second cocking cycle to slide the second hook in the extended position along the body thereby transferring the bowstring from the partially drawn position to a fully drawn position in which the bowstring engages a trigger latch.

20. The method of claim 19, wherein rotation of the cocking lever moves the second hook between the retracted position and the extended position; and wherein rotation of the cocking lever moves the handover latch between the retracted position and the extended position.

21. The method of claim 20, wherein returning the cocking lever to an initial closed position moves the second hook into the retracted position and moves the handover latch into the retracted position.

* * * * *